United States Patent [19]

Venning

[11] 4,450,822

[45] May 29, 1984

[54] GASEOUS FUEL DELIVERY SYSTEM

[76] Inventor: Scott J. Venning, 617 S. Busse Rd., Mt. Prospect, Ill. 60056

[21] Appl. No.: 417,630

[22] Filed: Sep. 13, 1982

[51] Int. Cl.[3] ..... F02M 13/08

[52] U.S. Cl. ..... 123/525; 123/575; 261/42; 48/180 R

[58] Field of Search ..... 123/525, 527, 576, 575, 123/526; 48/180.1; 261/42

[56] References Cited

U.S. PATENT DOCUMENTS

| | | | |
|---|---|---|---|
| 1,520,772 | 12/1924 | Ricardo | 123/525 |
| 2,050,978 | 8/1936 | Thatcher | 123/525 |
| 4,068,639 | 1/1978 | Cook | 123/525 |
| 4,227,497 | 10/1980 | Mathieson | 123/575 |
| 4,335,697 | 6/1982 | McLean | 123/525 |
| 4,369,751 | 1/1983 | Batchelor et al. | 123/525 |
| 4,373,493 | 2/1983 | Welsh | 123/525 |

*Primary Examiner*—Charles J. Myhre

*Assistant Examiner*—E. Rollins Gross

*Attorney, Agent, or Firm*—Robert V. Jambor

[57] ABSTRACT

A gaseous fuel delivery system for a gasoline engine having means for gaseous fuel delivery comprising idle fuel delivery means and acceleration fuel delivery means. Electrically operable means responsive to ported vacuum in the carburetor throat controls operation of the idle fuel delivery means. Electrically operable means responsive to intake manifold vacuum controls operation of the acceleration fuel delivery means. An idle switch responsive to idle position of the throttle prevents opening of the idle fuel delivery means except when the throttle is in the idle position.

The engine carburetor is arranged such that no gasoline is delivered for idle operation. Idle needle valves are closed, or eliminated. Transition slots are sized to be operational only as the throttle moves from the idle position and supply no fuel when the throttle is at idle.

32 Claims, 5 Drawing Figures

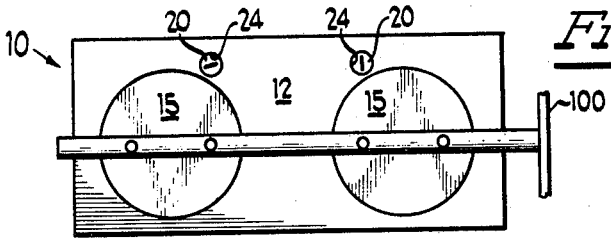
Fig 1
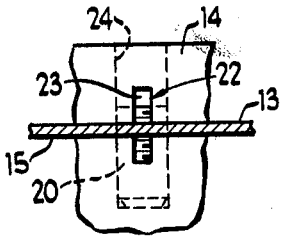
Fig 2a
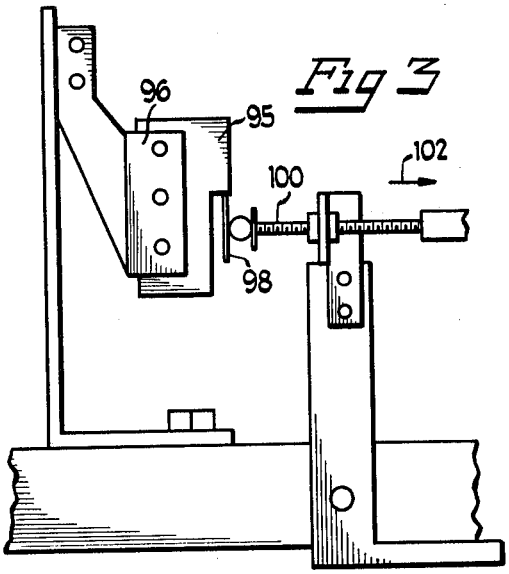
Fig 3
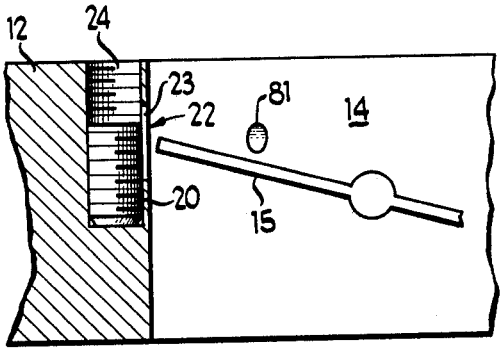
Fig 2b
Fig 4
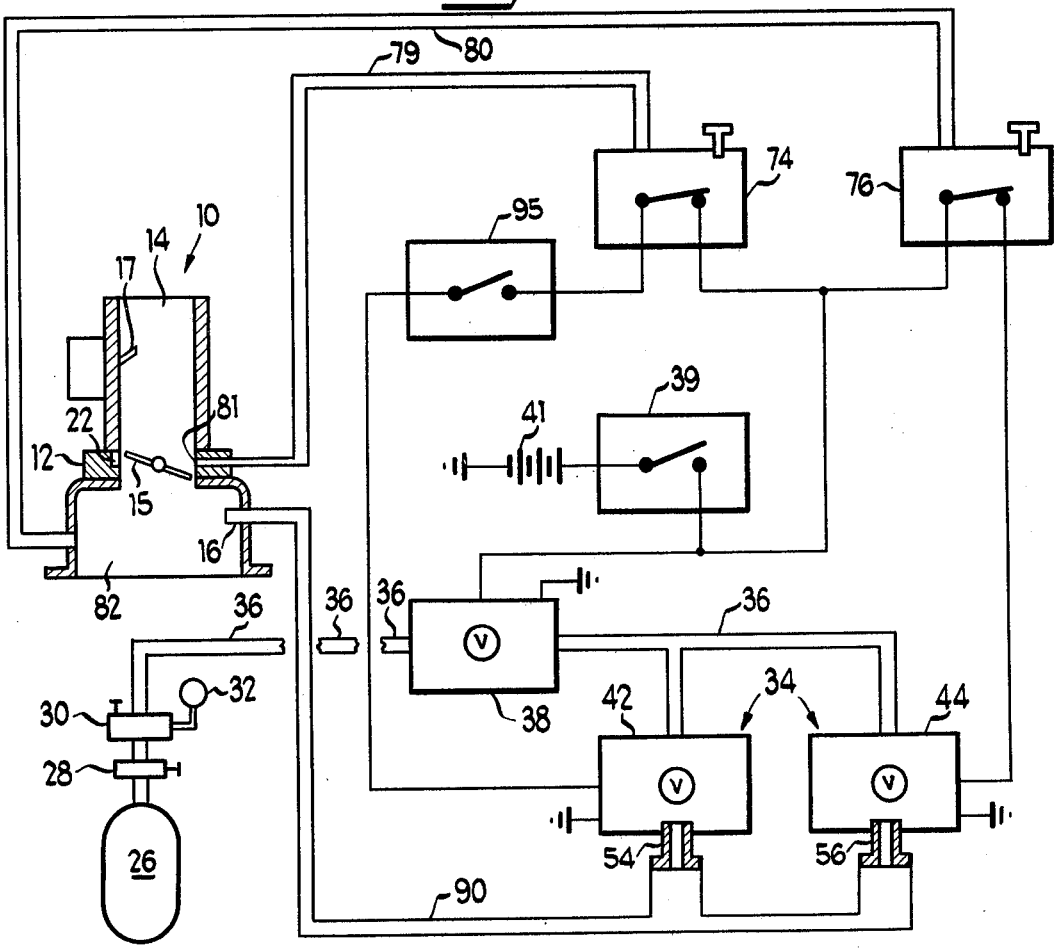

GASEOUS FUEL DELIVERY SYSTEM

BACKGROUND OF THE INVENTION

1. Field of the Invention

The present invention relates to a gaseous fuel delivery system for gasoline engines. More particularly it relates to a system which supplies gaseous fuel, such as propane, methane or natural gas to the gasoline engine during idle and acceleration conditions of operation. It is an improvement of the system described in U.S. Pat. No. 4,227,497.

2. Description of the Prior Art

The system disclosed in the aforesaid patent is intended to supply gaseous fuel to a gasoline engine during portions of the operating cycle in which gaseous fuel operation is more efficient. These selected operating conditions are idle, acceleration, and increaased load.

It was determined that the use of purely mechanical means to control idle gaseous fuel supply was troublesome and inaccurate. Also, dependency upon the relative magnitudes of engine vaccuum resulted in wide fluctuations in operating effectiveness. Unwanted operation of one or the other portion of the system to supply gaseous fuel when not intended further diminished overall efficiency. Importantly, it also was determined that for the idle operation, modification of the carburetor of the gasoline engine equipped for gaseous fuel supply was necessary to maximize efficiency.

SUMMARY OF THE PRESENT INVENTION

The present invention is intended to provide the advantages of gaseous fuel operation in a gasoline engine without the disadvantages of the earlier design. The present invention incorporates means responsive to engine operating conditions into the idle fuel supply portion to the system. It also eliminates variable control of gaseous fuel supply during acceleration and provides positive, electrically operated cutoff of the gaseous fuel supply during periods when such supply is unneeded. This arrangement eliminates the ability to automatically respond to variable load, but significantly improves idle and acceleration performance.

The system of the present invention is applicable to new as well as existing engines. It could be supplied as original equipment or added as a conversion at some later time.

In the preferred form, the system includes supply means responsive to ported vacuum in the carburetor venturi to permit supply of a preselected quantity of gaseous fuel during idle operation of the engine and responsive to intake manifold vacuum to permit supply of a preselected supplemental quantity of gaseous fuel during engine acceleration. It includes positive electrically operated means to insure delivery of idle or acceleration gaseous fuel supply only at the proper portions of the operating cycle.

The carburetor used with the system is arranged such that no gasoline fuel is delivered to the engine at idle, yet as operation is elevated above idle, a small supply of gasoline commences prior to termination of the idle gaseous fuel supply.

DESCRIPTION OF THE DRAWINGS

FIG. 1 is a top view of the base plate of the carburetor incorporating the system of the present invention.

FIG. 2*a* and 2*b* are fragmentary views of portions of the base plate of the carburetor of FIG. 1.

FIG. 3 is a fragmentary side elevational view of a portion of the carburetor of FIG. 1.

FIG. 4 is a diagrammatic view of the system of the present invention.

DETAILED DESCRIPTION

The system of the present invention is applied in conjunction with the carburetor of an internal combustion engine utilizing gasoline fuel. It is interconnected, for example, with a dual barrel carburetor 10 illustrated in the drawings, which includes a removable base plate 12, central throats 14 and pivotal butterfly valve plates 15 pivotally mounted in base plate 12 and controlled by the engine throttle linkage. Of course, a carburetor having additional or fewer barrels (venturis) could be utilized. Any suitable gasoline carburetor may be used, such as the products of Rochester Carburetor Company, a Division of General Motors Corporation. Specifics of carburetor functions to supply gasoline to an engine are illustrated and described in numerous reference works, such as, for example, "Rochester Carburetor", a publication of H. P. Books, P. O. Box 5367, Tucscon, Ariz. 85708, printed 1973, Library of Congress Catalog Card Number 72-91 685. Reference is made to that publication for an understanding of the typical gasoline carburetor with which the present invention is intended to cooperate.

Illustrated carburetor 10 is not wholly conventional. It is modified, or in the instance of original equipment, constructed differently from a carburetor for supplying only gasoline to an internal combustion engine. Carburetor 10 includes gaseous fuel inlet tube 16 through which the gaseous fuel is supplied in accordance with the present invention. This may be located above or below butterflys 15.

In accordance with the present invention, it is necessary to eliminate all supply of gasoline fuel at idle. Usually two sources exist, the main idle circuit, which includes adjustable idle fuel jets and in most carburetors transition slots, which are formed in the throat of carburetor adjacent the closed position of the butterfly valves.

Idle needle valves are closed so that no fuel is delivered to the idle circuit of the carburetor. The idle circuit is normally a passage separate from the throat and supplies gasoline and air even though the butterfly valves are closed or nearly closed. Fuel, metered through the idle needle valves, is the major idle fuel supply. In the present system all gasoline or liquid fuel supply is eliminated at idle.

As illustrated in FIGS. 1 through 3, the carburetor of the present invention includes transition slots 22, formed in throats 14 of carburetor 10, which permit quantities of gasoline to enter the carburetor throat 14. They generally operate to supplement idle fuel supply until the main carburetor jets 17 commence fuel delivery.

As seen in FIGS. 1, 2*a* and 2*b*, the base plate 12 of carburetor 10 has been modified to significantly shorten the "transition slots" 22 which exist in the walls forming the throats 14, such that they are closed at idle and not exposed to the high intake manifold vacuum below the closed butterflys. Thus, no gasoline can be drawn into the carburetor throat. In modifying an existing carburetor 10 the slots 22 are conveniently restricted by inserting set screws 20 from the top of carburetor base plate 12. Appropriate threaded holes 24 are formed in base plate 12 to accommodate threaded set screws 20.

It is important to note that the screws are positioned such that the transition slots are blocked when the butterfly plate is in the closed or idle position. That position of plate 15 at idle is as shown at 13 in FIG. 2*a*. At idle no gasoline can be drawn into the carburetor through the shortened portions 23 of slots 22, because they are above the closed portion of the butterfly. As the butterflys 15 are moved from the idle position, some amount of gasoline is drawn into the throats 14 through the shortened slots 23. This is intended to avoid any possible lag in operation as transition is made from idle to operational modes. It occurs, because as the butterflys 15 are pivoted toward the open or vertical position, the shortened slots 23 are exposed to the intake manifold vacuum.

The power valves of the carburetor 10 are also eliminated. This is done by removing, or in the case of originial equipment, excluding the typical power valves found in a carburetor which enrichens the fuel mixture under load. This substantially reduces the amount of liquid fuel which will enter the carburetor on acceleration.

The fuel delivery system illustrated in the embodiment in FIG. 4, includes a pressure vessel 26 for storage of a gaseous fuel supply, a shut-off valve 28, adjustable pressure regulator 30 with gauge 32, supply means generally designated 34, and connecting delivery conduits 36. The fuel utilized may be propane, methane, natural gas or similar suitable gaseous fuel. The vessel 26 may be placed in any suitable location, for example, in automotive applications it may be placed in the trunk, or between the frame rails.

Regulator 30 and guage 32 are utilized to set an appropriate supply pressure for delivery of gaseous fuel to the system at essentially constant preset pressure. As can be appreciated, the pressure level will vary with the size of the engine with which the system is associated. Typically, a system for an engine of 200 cubic inch displacement will operate satisfactorily at 1½ to 2.0 psig. (pounds per square inch, gauge) supply pressure.

Fuel supply line 36 provides a connection between regulator 30 and supply means 34. Interposed in line 36 is a normally closed solenoid valve 38 connected to the electrical power supply of the engine, which in this embodiment includes battery 41. Solenoid 38 is operated by oil pressure switch 39 which closes the electrical circuit and permits solenoid 38 to open only when the engine is cranking and has developed oil pressure.

Referring now to FIG. 4, there is shown a form of the present invention. In this embodiment the gaseous fuel delivery means 34 takes the form of two separate normally closed idle and acceleration solenoid valves 42 and 44, which when energized, permit passage of gaseous fuel respectively through idle and acceleration orifices 54 and 56 into delivery conduit 90. Delivery conduit 90 communicates with supply tube 16, which in this embodiment is illustrated as communicating with the intake manifold 82 of the engine. Tube 15 could, of course, be connected to carburetor 10.

The solenoid valves may be Skinner #BZ DA 1052 valves or like valves from other sources. Skinner valves are made by Skinner Electric Valve Co., New Britain, Conn.

Orifice 54 is sized to control the rate of flow of gaseous fuel into the engine under idle conditions. Orifice 56 is sized to control the rate of flow of gaseous fuel under conditions of acceleration. For a 200 cubic inch displacement engine, with gaseous fuel supply delivered at 1½ to 2 psig., it has been determined that the orifice size for idle solenoid valve 42 should be in the range of 0.040–0.070 inches in diameter and the orifice size of acceleation orifice 44 should be in the range of 0.060 to 0.080 inches in diameter.

Two vacuum switches, idle vacuum switch 74 and acceleration vacuum switch 76, are provided which control operation of idle and acceleration solenoids 42 and 44. These switches may be Hobbs Vacuum Switches Series 4000 made by Stewart-Warner Corporation, Hobbs Division, Springfield, Ill. They are adjustable to operate between 2–22 inches of mercury vacuum. It should be understood that vacuum is a negative value. That is, a vacuum near zero, measured in inches of mercury, is a smaller or lesser vacuum than a vacuum of 4 or 10 inches of mercury.

Idle vacuum switch 74 is connected via conduit 79 to port 81 to sense the flow of air through venturi 14 of carburetor 10. Port 81 is located as would be a vacuum advance port, such that when butterfly valve 15 is closed, port 81 is above the valve. When the butterfly is open, port 81 is exposed to intake manifold vacuum.

Switch 74 is normally a closed switch, so that when period vacuum is lost, as at idle, the switch is closed and solenoid 42 is energized to permit flow of gaseous fuel through orifice 54, the only fuel being delivered at idle conditions. However, normally open solenoids and normally open valves could readily be used without departing from the invention concept.

As engine operation exceeds idle, air flow through throat 14 commences and vacuum begins to develop at orifice 81. When this vacuum exceeds a level preset in switch 74, for example 3–4 inches of mercury, switch 74 opens, de-energizing solenoid 42 and closing the passage through orifice 54.

Switch 76 is connected via conduit 80 to the intake manifold 82 to sense intake manifold vacuum. It is a normally closed switch and responds to loss of vacuum, as occurs under acceleration conditions to close the circuit to solenoid 44 to permit flow of gaseous fuel through orifice 56 to supplement the normal operating supply of gasoline entering via jet 17. Vacuum switch 76 is sized such that upon experiencing an intake manifold vacuum in excess of about 4–6 inches of mercury, it opens to close acceleration fuel supply solenoid 44.

Adjustment of switches 74 and 76 may be varied to vary the operating characteristics of the system. Switch 74 is preferably set to close the circuit to solenoid valve 42 whe ported vacuum decreases to 6–4 inches of mercury. Switch 76 is preferably set to close the circuit to solenoid valve 44 when intake manifold vacuum decreases below 6–4 inches of mercury. However, these parameters may be varied to accommodate special circumstances, or specific engine peculiarities.

To insure operation of the idle fuel supply solenoid 42 only at idle conditions, a microswitch 95 is positioned upon carburetor 10 to sense the position of the throttle linkage. It permits solenoid 42 to be operated only during idle conditions. This is necessary since at certain conditions of the engine operating cycle, ported vacuum may decrease below 4 inches of mercury even though the engine is not at idle. A UNIMAX #2HB113-1 is a suitable switch for this application.

As best seen in FIG. 3, normally open microswitch 95 is positioned on a bracket 96 with actuator arm 98 disposed to contact throttle linkage 100. Movement of linkage 100 away from idle as shown by arrow 102 causes linkage 100 to move away from actuator 98 and open microswitch 95. Switch 95 is connected in series with switch 74 and solenoid 42.

Starting is initiated by cranking with any suitable cranking motor. This develops sufficient engine oil pressure to close switch 39 to connect the electric circuit to the battery 41. The normally closed solenoid valve 38 is energized and gaseous fuel is made available to the supply means 34.

Starting normally requires more air flow into the engine than is available with a closed throttle, so throttle linkage 100 is operated to at least partially open butterfly 15. This permits air to enter the intake manifold 82 through venturi 14, which draws gasoline through main jet 17. Throttle movement also supplies gasoline for starting through conventional accelerator pumps (not shown) in the carburetor.

At the commencement of engine start-up, both vacuum switches 74 and 76 experience zero vacuum and, hence, solenoid valves 42 and 44 are energized and open across the orifices 54 and 56. Some gaseous fuel, therefore, is at least initially supplied on startup, at least through solenoid 44.

After the engine starts, sufficient intake manifold vacuum develops, i.e., 4–6 inches of mercury, or more, and switch 76 closes valve 44. Gaseous fuel flow through valve 44 is terminated.

There is no flow through solenoid 42, even though electrical energy is available to solenoid 84 because switch 95 is open during starting as a result of the open position of throttle butterfly 15. Once the engine starts, flow of air through venturi 14 creates sufficient ported vacuum, i.e., 4–6 inches of mercury, or more, at port 81 of conduit 79 to open switch 74 and close valve 42. Also, throttle linkage 100 is in other than the idle position and switch 95 remains open.

Placement of the throttle in the idle position, as illustrated in the drawings, severely restricts air flow into the engine. This air flow passes through the slight annulus between throats 14 and butterflys 15, or through holes drilled in the butterflys for that purpose. Throttle plates 15 are nearly against screws 20 in the shortened transition slots 22. The open portions 23 are above the butterflys. No fuel enters through the shortened slots.

Restricted flow causes loss of ported vacuum, i.e., to less than 4 inches of mercury. Intake manifold vacuum increases substantially to the range of 17–18 inches of mercury. Switch 74 opens and, therefore, the solenoid valve 42 closes permitting flow across orifice 54 into conduit 90. At the same time, switch 76 closes to close valve 44. Linkage 100 is in the idle position and, therefore, switch 95 is also closed, which permits the closure of switch 24 to energize and open solenoid 42. Gaseous fuel is permitted to flow into the carburetor through conduit 90 and inlet tube 16.

Modified transition slots permit elevation of the power level of the engine from idle without lag sudden drop in engine output. As butterfly valve 15 is opened, the shortened portions 23 of the slots are exposed to intake manifold vacuum and the air flowing through venturi 14 draws gasoline from the reduced size transition slot. Also, as the butterflys 15 open above the port 81, it is exposed to intake manifold vacuum. Also, air flow past butterflys 15 increases. These factors increase ported vacuum and cause closure of gaseous idle fuel solenoid 42. As throttle linkage is moved from idle, switch 95 opens and de-energizes solenoid 42, further insuring termination of gaseous fuel supply through conduit 90. Transition slots 23, however, permit gasoline flow as soon as butterflys 15 are moved above the set screws 20. This opens slots 23 to intake manifold vacuum and allows liquid fuel to be delivered simultaneously with, or immediately prior to termination of idle gaseous fuel supply.

Under normal load, butterflys 15 are open to a position dependent on load requirements. Air flow through venturi 14 creates sufficient ported vacuum, i.e., over 4–6 inches of mercury, to hold switch 74 open to maintain solenoid 42 closed. There is also sufficient intake manifold vacuum, i.e., in excess of 4–6 inches of mercury, to hold switch 76 open to maintain valve 44 closed. Throttle linkage 100 is out of the idle position. Hence, switch 95 is open and solenoid 42 remains de-energized. Under these conditions, fuel is suplied solely in liquid form through carburetor 10.

On acceleration, throttle 100 is operated to further open butterfly 15. This results in a loss of intake manifold vacuum. As that parameter reduces to 4–6 inches of mercury or less, vacuum switch 74 closes to open solenoid 44.

Opening of valve 44 permits gaseous fuel to pass between orifice 56 and into passage or conduit 90 and delivery tube 16 to supplement gasoline drawn into carburetor 10 through jet 17. Use of gaseous fuel to supplement gasoline under acceleration is advantageous because gaseous fuel is of a higher octane and enrichens the total fuel mixture using less fuel than if operated on liquid fuel alone.

Once steady state load conditions are reached, throttle butterflys 15 are moved toward a more closed position and intake manifold vacuum again exceeds b 4–6 inches of mercury. This opens switch 76 and solenoid 44 is closed to shut-off acceleration gaseous fuel supply. Ported vacuum is sufficient to keep switch 74 open and, thus, solenoid valve 42 is also closed. Also, since throttle linkage 100 is not in the idle position, switch 95 causes solenoid 42 to remain de-energized. No gaseous fuel is supplied to the engine until a condition of idle or acceleration is re-established.

In the embodiment of FIG. 4, an arrangement capable of providing gaseous fuel only at idle is readily obtained. The system utilizes vacuum switch 74, solenoid 42 and idle switch 95. Vacuum switch 76 and solenoid 44 are eliminated.

In this system switch 74, normally closed, is open whenever ported vacuum exceeds preset conditions, usually above 4–6 inches of mercury. Therefore, solenoid 42 is de-energized and no flow occurs across orifice 54. However, when the throttle is placed in the idle position, ported vacuum is lost and switch 95, which sense the idle position of the throttle linkage, also closes and solenoid 42 is energized, supplying only gaseous fuel to the engine.

In this latter embodiment, using gaseous fuel only at idle, previously described carburetor modifications of closing the idle needle valves and partially blocking the transition ports are necessary. Modifications to the power valves would not be made since their function would be necessary to acceleration operation.

Various features of the present invention have, hence, been disclosed in connection with the illustrated embodiments of the present invention. However, numerous modifications may be made without departing from the spirit and scope of the invention as defined by the appended claims.

I claim:

1. A gaseous fuel delivery system for an internal combustion engine operable on gasoline and having a carburetor to supply gasoline thereto, said carburetor being arranged to supply gasoline only at other than idle conditions, the combination comprising:

(a) idle delivery means responsive to engine operating conditions to supply gaseous fuel to said engine when said engine is operating at idle;

(b) conduit means communicating said idle delivery means to a source of gaseous fuel and to said engine;

wherein said system includes means responsive to ported vacuum of a port in the carburetor throat to open and close said idle delivery means, said system including means communicating said port and said idle delivery means, said means responsive to ported vacuum opening said idle delivery means when said engine is operating at idle and closing said idle delivery means when said engine is operating at other than idle.

2. A gaseous fuel delivery system as claimed in claim 1 wherein said idle delivery means comprises an idle solenoid valve and said means responsive to ported vacuum includes a vacuum switch communicating to ported vacuum and connected to operate said idle solenoid valve.

3. A gaseous fuel delivery system as claimed in claim 2 wherein said switch permits opening of said idle solenoid valve when the ported vacuum is of a magnitude of about 4 to 6 inches of mercury or less, closing said valve when said vacuum exceeds said 4 to 6 inches of mercury.

4. A gaseous fuel delivery system as claimed in claim 3 wherein said solenoid valve includes an orifice controlling the flow of gaseous fuel therethrough, said orifice being about 0.040 to 0.070 inches in diameter.

5. A gaseous fuel deivery system as claimed in claim 4 wherein the supply of gaseous fuel is regulated to between 1½ to 2 pounds per square inch supply pressure.

6. A gaseous fuel delivery system as claimed in claim 2 wherein said system further includes a switch responsive to throttle position said switch permitting said solenoid to operate only when said throttle linkage is in the idle position.

7. A gaseous fuel delivery system for an internal combustion engine operable on liquid fuel comprising:

(a) a supply of gaseous fuel under pressure;

(b) a source of electrical power;

(c) a gaseous fuel delivery means comprising:

(1) an idle solenoid valve;

(2) an acceleration solenoid valve;

(d) conduit means communicating said gaseous fuel from said supply to each said idle solenoid valve and acceleration solenoid valve and from said valves to said engine;

(e) means responsive to engine operation to open and close said fuel delivery means, including means responsive to ported vacuum to open and close said idle solenoid valve; means responsive to intake manifold vacuum to open and close said acceleration solenoid valve.

8. A gaseous fuel delivery system for an internal combustion engine as claimed in claim 7 wherein said system further includes idle switch means responsive to the position of the throttle of said engine to permit opening of said idle solenoid valve only when said throttle is in the idle position.

9. A gaseous fuel delivery system as claimed in claim 7 wherein said means responsive to engine operation includes an idle solenoid switch in communication with a port formed in the carburetor throat to sense ported vacuum and connected to said idle solenoid valve.

10. A gaseous fuel delivery system as claimed in claim 7 wherein said means responsive to engine operation includes an acceleration solenoid switch in communication with a port in the engine intake manifold to sense intake manifold vacuum and connected to said acceleration solenoid valve.

11. A gaseous fuel delivery system as claimed in claim 9 wherein said means responsive to engine operation includes an acceleration solenoid switch communicating with intake manifold vacuum and connected to said acceleration solenoid valve.

12. A gaseous fuel delivery system as claimed in claim 9 wherein said idle solenoid valve includes an orifice to control the flow of gaseous fuel therethrough, said orifice being about 0.040 to 0.070 inches in diameter.

13. A gaseous fuel delivery system as claimed in claim 10 wherein said acceleration solenoid valve includes an orifice to control the flow therethrough, said orifice being about 0.060 to 0.080 inches in diameter.

14. A gaseous fuel delivery system as claimed in claim 12 wherein said supply of gaseous fuel under pressure is supplied at about 1½ to 2 pounds per square inch.

15. A gaseous fuel delivery system as claimed in claim 13 wherein said supply of gaseous fuel under pressure is supplied at about 1½ to 2 pounds per square inch.

16. A gaseous fuel delivery system for an internal combustion engine as claimed in claim 15 wherein said idle switch opens said idle solenoid valve when the ported vacuum is about 4 to 6 inches of mercury or less.

17. A gaseous fuel delivery system for an internal combustion engine as claimed in claim 10 wherein said acceleration switch opens said acceleration solenoid valve when said engine intake manifold vacuum is about 4 to 6 inches of mercury or less.

18. A gaseous fuel delivery system as claimed in claim 11 wherein said idle switch opens said idle solenoid valve when the ported vacuum is about 4 to 6 inches of mercury or less, and said acceleration switch opens said acceleration solenoid valve when said engine intake manifold vacuum is about 4 to 6 inches of mercury or less.

19. A gaseous fuel delivery system as claimed in claim 18 wherein said idle switch closes said idle solenoid when said ported vacuum exceeds 4–6 inches of mercury and said acceleration switch closes said acceleration solenoid when said intake manifold vacuum exceeds 4 to 6 inches of mercury.

20. A gaseous fuel delivery system as claimed in claim 19 wherein said system includes idle switch means responsive to the engine throttle position to permit opening of said idle solenoid valve only when said throttle is in said idle position.

21. A gaseous fuel delivery system as claimed in claim 7 wherein said internal combustion engine includes a carburetor to supply gasoline to said engine, said carburetor being arranged to supply gasoline to said engine only at other than idle conditions.

22. A gaseous fuel delivery system as claimed in claim 21 wherein said carburetor has no power valves.

23. A gaseous fuel delivery system as claimed in claim 19 wherein said internal combustion engine includes a carburetor to supply gasoline to said engine, said carburetor being arranged to supply gasoline to said engine only at other than idle conditions.

24. A gaseous fuel delivery system as claimed in claim 23 wherein said carburetor further having no power valves.

25. A method of converting an internal combustion engine operable on gasoline to operate on gasoline and gaseous fuel, said engine including a gasoline carburetor having at least one throat and a pivotal butterfly disposed therein, at least one transition slot extending above and below said butterfly when said butterfly is in a closed position, and communicating between said throat and a supply of gasoline fuel, the steps comprising:

(a) blocking the idle gasoline fuel supply circuit of said carburetor;

(b) partially blocking said transition slot such that it exists only above said butterfly when said butterfly is in said closed position;

(c) providing a supply of gaseous fuel under pressure;

(d) providing a source of electrical power;

(e) providing a gaseous fuel delivery means comprising:

(1) an idle solenoid valve;

(2) an accleration solenoid valve;

(f) providing conduit means communicating said gaseous fuel from said supply to each said idle solenoid valve and acceleration solenoid valve and from said valves to said engine;

(g) providing means responsive to engine operation to open and close said fuel delivery means, including means responsive to ported vacuum to open and close said idle solenoid valve; and providing means responsive to intake manifold vacuum to open and close said acceleration solenoid valve.

26. A method as claimed in claim 25 further comprising providing idle switch means responsive to the position of the throttle of said engine to permit opening of said idle solenoid valve only when said throttle is in the idle position.

27. A method as claimed in claim 25 wherein said means responsive to engine operation includes an idle solenoid switch, connecting said switch in communication with a port formed in the carburetor throat to sense ported vacuum and connecting to said switch to said idle solenoid valve.

28. A method as claimed in claim 25 wherein said means responsive to engine operation includes an acceleration solenoid switch, connecting said switch in communication with a port in the engine intake manifold to sense intake manifold vacuum and connecting said switch to said acceleration solenoid valve.

29. A method as claimed in claim 27 wherein said means responsive to engine operation includes an acceleration solenoid switch, connecting said switch in communication with intake manifold vacuum and to said acceleration solenoid valve.

30. A method as claimed in claim 29 further including supplying said supply of gaseous fuel under pressure at about 1½ to 2 pounds per square inch.

31. A method as claimed in claim 30 wherein said idle switch opens said idle solenoid valve when the ported vacuum is about 4 to 6 inches of mercury or less.

32. A method as claimed in claim 30 wherein said acceleration switch opens said acceleration solenoid valve when said engine intake manifold vacuum is about 4 to 6 inches of mercury of less.

* * * * *